US005476371A

United States Patent [19]

Dreiman

[11] Patent Number: 5,476,371

[45] Date of Patent: Dec. 19, 1995

[54] COMPRESSOR SUCTION VALVE OF TOROIDAL SHAPE WITH A RADIAL FINGER

[75] Inventor: Nelik I. Dreiman, Tipton, Mich.

[73] Assignee: Tecumseh Products Company, Tecumseh, Mich.

[21] Appl. No.: 254,633

[22] Filed: Jun. 8, 1994

[51] Int. Cl.[6] ..... F04B 21/02; F04B 39/10; F04B 53/12

[52] U.S. Cl. ..... 417/550; 417/551.1; 417/553; 417/902; 92/181 P

[58] Field of Search ..... 417/555.1, 550, 417/553, 902; 137/516.19, 516.21; 92/181, 181 P

[56] References Cited

U.S. PATENT DOCUMENTS

| | | | |
|---|---|---|---|
| 109,732 | 11/1870 | Haskins . | |
| 805,850 | 11/1905 | Ginaca . | |
| 1,354,318 | 9/1920 | Longacre | 137/516.19 |
| 1,379,173 | 5/1921 | Decrow . | |
| 1,870,927 | 8/1932 | Schoene . | |
| 1,986,944 | 1/1935 | Schoene . | |
| 2,117,601 | 5/1938 | Browne . | |
| 3,438,394 | 4/1969 | Nakib | 137/516.19 |
| 3,536,094 | 10/1970 | Manley, Jr. . | |
| 3,594,824 | 7/1971 | Nakib . | |
| 3,752,604 | 8/1973 | Dorn | 417/553 |
| 4,184,818 | 1/1980 | Petrovsky . | |
| 4,543,989 | 10/1985 | Lorson . | |
| 4,688,999 | 8/1987 | Ames et al. | 417/550 |
| 4,834,632 | 5/1989 | Gatecliff . | |
| 4,924,906 | 5/1990 | Hrabal . | |
| 4,955,796 | 9/1990 | Terwilliger . | |
| 5,080,130 | 1/1992 | Terwilliger . | |
| 5,080,565 | 1/1992 | Shultz et al. | 417/550 |
| 5,106,278 | 4/1992 | Terwilliger . | |
| 5,174,735 | 12/1992 | Gannaway | 417/550 |
| 5,203,857 | 4/1993 | Terwilliger . | |
| 5,266,015 | 11/1993 | Gannaway | 417/550 |

FOREIGN PATENT DOCUMENTS

| | | | |
|---|---|---|---|
| 191761 | 11/1909 | Germany | 137/516.21 |

*Primary Examiner*—Richard A. Bertsch
*Assistant Examiner*—Ted Kim
*Attorney, Agent, or Firm*—Baker & Daniels

[57] ABSTRACT

A compressor assembly is disclosed including a compressor mechanism mounted within a hermetically sealed housing. A cylinder block contains a reciprocating piston having a suction valve assembly. The piston includes a head with a deep semitorus shaped annular groove with a similarly shaped solid suction valve that seats thereto. A retaining mechanism including a clamping bolt with a plurality of radially extending fingers is used to reduce valve inertia and impact forces. The fingers behave as cantilevered beam springs.

28 Claims, 3 Drawing Sheets

COMPRESSOR SUCTION VALVE OF TOROIDAL SHAPE WITH A RADIAL FINGER

BACKGROUND OF THE INVENTION

The present invention relates generally to a hermetic compressor and, more particularly, to a compressor having a reciprocating piston including a suction valve assembly located therein.

In general, hermetic compressors comprise a hermetically sealed housing having a compressor mechanism mounted therein. The compressor mechanism may include a crankcase or a cylinder block defining a compression chamber in which gaseous refrigerant is compressed and subsequently discharged.

A disadvantage to prior compressor designs is that there is always a certain volume left in the cylinder when the piston is at top dead center position. This volume of gas is repetitively compressed and re-expanded during the reciprocation of the piston. Reexpansion volume causes a loss of energy efficiency in a compressor.

In prior art compressors utilizing valve-in-piston designs disclosed, for example, in U.S. Pat. No. 2,117,601 and U.S. Pat. No. 4,834,632, the suction valve is mounted adjacent the top surface of the piston head and is axially reciprocatingly displaceable in the space limited by the piston top surface and the valve retainer. The separate spacer washer, located in the same limited space, guides the movement of the valve and defines the possible amount of valve lift. An overlapping screw head or washer retains movement of the ring type valve and, simultaneously clamps the spacer washer between screw head and the piston head top surface. Due to the fact that the spacer washer is slightly thicker than the valve, the valve is allowed limited axial movement beneath the screw head.

Because of the location of the suction valve above the surface at the piston top in the prior art valve-in-piston design, space has been provided in the valve plate to accommodate the valve, and its guiding and retaining members. This increases the clearance volume, complicates assembly of the valving system, and increases the manufacturing cost of the compressor.

The location of the circular retainer in the vicinity of the central part of the valve, while the gas dynamic forces are applied to the peripheral part of the ring valve, localize forces acting at the center thereof and drastically increase polar inertia momentum of the valve. As the valve strikes the retainer, a relatively large amount of stress is placed on the retainer that may cause damage, due to the forces concentrated in the central part and/or due to accumulation of wear due to repeated collisions of the parts.

Use of ring type valves made from steel are common in prior art compressors. The ability of such valves steel to resist the stresses created by repeated bending (flexural stress) and impact stresses caused by colliding of the valve with the seat/stop is one of the essential properties of prior art valve steel. As shown in numerous studies, a valve material with higher damping characteristics will absorb induced stress peaks more efficiently, minimize valve damage, and reduce a noise generating by such impacts.

Further, gas passages in prior art suction valves have normally only included a single outside gas passage. By limiting the valves to a single outside gas passage, throttling occurs reducing compressor efficiency.

A plastic valve disk is known from U.S. Pat. Nos. 4,955,796 and 5,106,278. This plastic valve has been mounted on the top of the piston for limited, axial floating motion sufficient to close or open gas passages located in the top of the piston. Such a design of the plastic valve reduces, to some degree, valve flexural stress, but still includes a source of concentrated impact stress due to the central location of the retaining means. Another disadvantage of such a plastic valve disk is the use of the bridging cover in the central part of the valve, which is affixed to the disk body by screws and plastic welding. It is noted that the excess flexing of the plastic material by itself presents a problem. The central bridging plastic part requires some type of re-enforcement due to the tendency for the thin plate, suspended at an edge, to buckle or warp under influence of changing gas pressure.

An objective of the proposed invention is to provide a reliable suction valve system with an improved design for gas passages which will increase effective valve flow area and minimize the pressure drop and cylinder clearance volume. The present invention also reduces turbulence formation, decreases noise generated by the valving system and is inexpensive to manufacture.

SUMMARY OF THE INVENTION

The present invention overcomes the aforementioned problems associated with prior art compressors by providing suction valve assembly with an effective valve flow area and a minimum pressure drop and cylinder reexpansion volume.

Generally, the invention provides a piston reciprocating within a cylinder block. On the piston is mounted a suction valve and piston assembly. The piston includes a head with a deep semi-torus shaped annular groove defining a suction valve cavity with a plurality of openings at its bottom that permit fluid communication through the suction port between the front and rear of the piston.

A raised central portion in the valve cavity formed by the inner surface of the semi-torus groove includes a central aperture to accommodate a retaining means such as an elongate threaded clamping bolt with a specially shaped head. The specially shaped head of the clamping bolt is utilized as a suction valve retainer. The flat head of the clamping bolt is an integral part of the bolt with a plurality of fingers radially extending therefrom.

The sidewalls of the annular groove form a seat for a semitorus shaped valve. The curved surface of the solid suction valve facing the piston interior has the same geometrical dimensions as the annular groove in the piston head. During opening, the solid valve at its final open position collides with the free ends of the clamping bolt fingers. The fingers of the clamping bolt, at that moment, each behave as a cantilevered beam spring. The impact forces generated during collision of the valve with the retainer are distributed along a flat open portion of the valve as opposed to the central portion as has been previously accomplished in the art.

An advantage of the reciprocating compressor of the present invention is that the new suction valve assembly de-localizes the spring center retainer means of the valve and piston assembly therefore reducing localized stress on the valve member yielding a longer valve life.

Another advantage of the reciprocating compressor of the present invention is that the extending fingers on the retaining means create structurally strong cantilevered beams that lengthen valve retainer life. Formation of these extending fingers yields a stable structure that distributes impact forces during valve opening.

Yet another advantage of the reciprocating compressor of the present invention is that the new solid suction valve has its entire rear surface area exposed immediately on opening. By maximizing the area exposed to the suction pressure on valve opening, valve acceleration is increased during valve opening. Increased valve acceleration increases compressor performance.

The invention, in one form thereof, provides a reciprocating compressor including a hermetically sealed housing in which cylinder block with a bore is disposed. A cylinder head assembly defining a discharge port is attached over the cylinder bore with a discharge valve mounted to the cylinder head assembly over the discharge port. A piston is disposed within the bore for reciprocating motion, the piston including a front surface with an annular depression, a rear surface and a suction port extending therethrough from the rear to the front. The suction port is at substantially suction pressure. A drive mechanism is included for reciprocating the piston within the bore to compress refrigerant. A suction valve is slidably attached to the piston over the suction port on the piston front surface. The suction valve includes a top and bottom surface in which the bottom surface is toroidally shaped wherein during valve opening, the bottom surface is immediately fully exposed to suction pressure.

In one form of the invention, the front piston surface includes a semi-torus shaped annular groove to which the suction valve seals. The annular groove is in communication with the suction port of the piston.

The invention, in another form thereof, provides a compressor including a cylinder block having a bore both of which are disposed within a housing. A cylinder head assembly defining a discharge port with an attached discharge valve is attached over the cylinder bore. A reciprocating piston is disposed within the bore attached to a drive means for reciprocating the piston. The piston includes a front surface and rear surface through which a suction port extends. The suction port is at substantially suction pressure. A clamping bolt is attached to the piston including at least one radial finger with a suction valve slidable on the clamping bolt to an open and closed position so that the suction valve may seal the suction port when it is in its closed position. The radial finger of the clamping bolt is in contact with the top surface when the suction valve is in an open position so that the radial finger reduces opening stress on the suction valve. In one form of the invention, the suction valve-includes a recess on its top surface so that the radial finger is received within the recess when the suction valve is in its fully open position.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
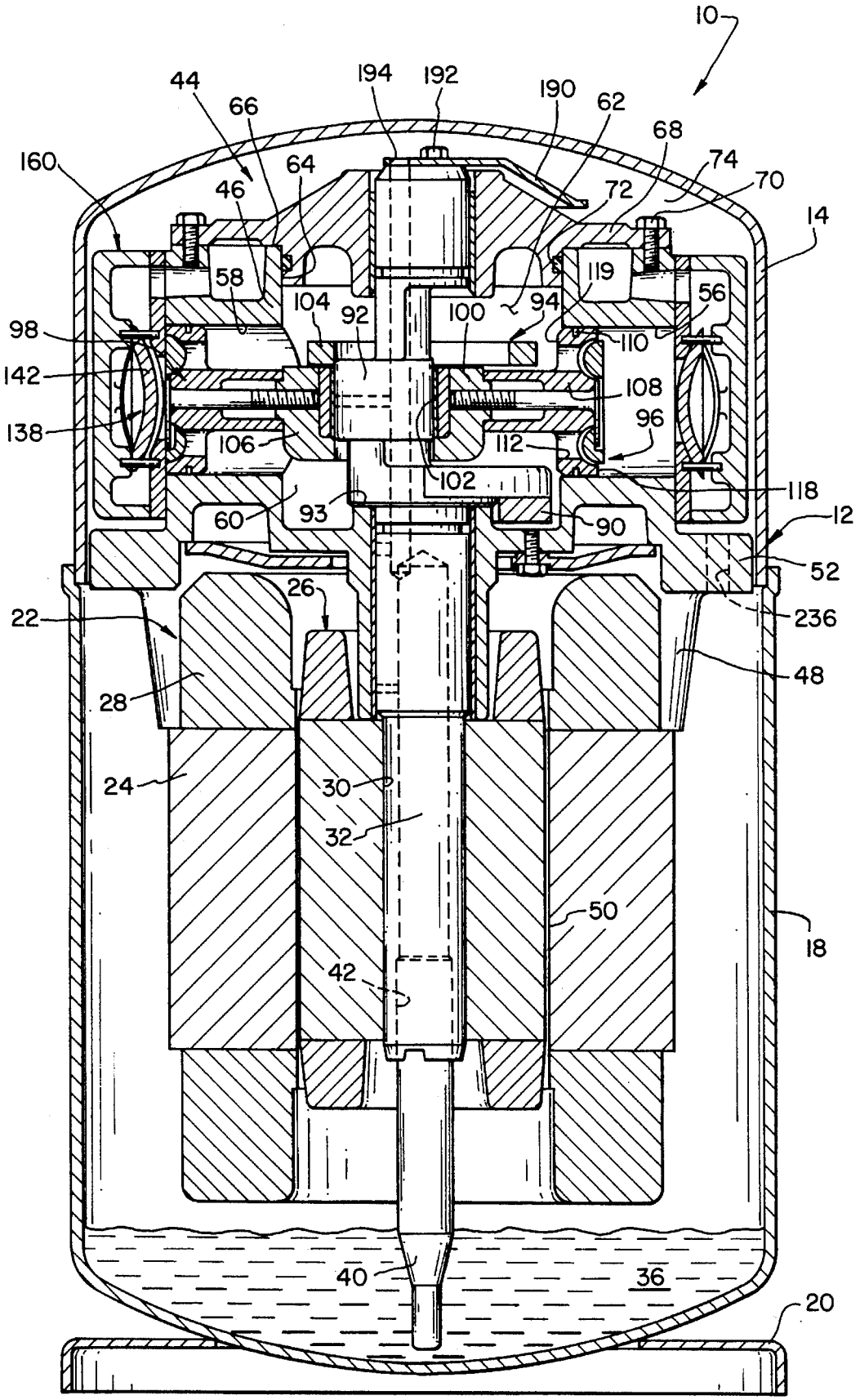
FIG. 1 is a longitudinal cross sectional view of a compressor incorporating the present invention.

Corresponding reference characters indicate corresponding parts throughout the several views. The exemplifications set out herein illustrate preferred embodiments of the invention, in one form thereof, and such exemplifications are not to be construed as limiting the scope of the invention in any manner.

DESCRIPTION OF THE PREFERRED EMBODIMENT

In an exemplary embodiment of the invention as shown in the drawings, and in particular by referring to FIG. 1, a compressor assembly 10 is shown having a housing generally designated at 12. The housing has a top portion 14 and a bottom portion 18. The two housing portions are hermetically secured together as by welding or brazing. A mounting flange 20 is welded to the bottom portion 18 for mounting the compressor in a vertically upright position. Located within hermetically sealed housing 12 is an electric motor generally designated at 22 having a stator 24 and a rotor 26. Stator 24 is provided with windings 28. Rotor 26 has a central aperture 30 provided therein into which is secured a crankshaft 32 by an interference fit. A terminal cluster (not shown) is provided in bottom portion 18 or housing 12 for connecting the compressor to a source of electric power.

Compressor assembly 10 also includes an oil sump 36 located in bottom portion 18. A centrifugal oil pick-up tube 40 is press fit into a counterbore 42 in the end of crankshaft 32. Oil pick-up tube 40 is of conventional construction and includes a vertical paddle (not shown) enclosed therein.

Also enclosed within housing 12, in the embodiment shown in FIG. 1, is a scotch yoke compressor mechanism generally designated at 44. A complete description of a basic scotch yoke compressor design is given in U.S. Pat. No. 4,838,769 assigned to the assignee of the present invention and expressly incorporated herein by reference.

Compressor mechanism 44 comprises a crankcase or cylinder block 46 including a plurality of mounting lugs 48 to which motor stator 24 is attached such that there is an annular air gap 50 between stator 24 and rotor 26. Crankcase 46 also includes a circumferential mounting flange 52 axially supported within an annular ledge 54 in central portion 16 of the housing. The lower portion of crankcase 46 and mounting flange 52 serve to divide the interior of the housing 12 into an upper chamber in which the compressor mechanism 44 is mounted and a lower chamber in which motor 22 is disposed. A passage 236 extends through flange 52 to provide communication between the top and bottom ends of housing 12 for return of lubricating oil and equalization of discharge pressure within the entire housing interior.

Compressor mechanism 44, as illustrated in the preferred embodiment, takes the form of a reciprocating piston, scotch yoke compressor. More specifically, crankcase 46 includes four radially disposed cylinders, two of which are shown in FIG. 1 and designated as cylinder 56 and cylinder 58. The four radially disposed cylinders open into and communicate with a central suction cavity 60 defined by inside cylindrical wall 62 in crankcase 46. A relatively large pilot hole 64 is provided in a top surface 66 of crankcase 46. Various compressor components, including the crankshaft, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, and 0-ring seal 72 isolates suction cavity 60 from a discharge pressure space 74 defined by the interior of housing 12.

Crankshaft 32 is rotatably journalled in crankcase 46, and extends through a suction cavity 60. Crankshaft 32 includes a counterweight portion 90 and an eccentric portion 92 located opposite one another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 1, piston assemblies 96 and 98, representative of four radially disposed piston assemblies operable in compressor assembly 10, are associated with cylinder bores 56 and 58, respectively.

Scotch yoke mechanism 94 comprises a slide block 100 including a cylindrical bore 102 in which eccentric portion 92 is journalled. Scotch yoke mechanism 94 also includes a pair of yoke members 104 and 106 which cooperate with slide block 100 to convert orbiting motion of eccentric portion 92 to reciprocating movement of the four radially disposed piston assemblies. For instance, FIG. 1 shows yoke member 106 coupled to piston assemblies 96 and 98 of the present invention, whereby when piston assembly 96 is at a bottom dead center position, piston assembly 98 will be at a top dead center position.

A counterweight 190 is attached to the top of shaft 32 by means of an off-center mounting bolt 192. An extruded hole 194 through counterweight 190 aligns with axial oil passageway 174, which opens on the top of crankshaft 32 to provide an outlet for oil pumped from sump 36.

Referring once again to piston assemblies 96 and 98 of the present invention, each piston assembly comprises a piston member 108 to reciprocate within a cylinder bore to compress gaseous refrigerant therein. Piston member 108 includes an annular piston ring 110 in the outer wall 111 thereof. Suction ports 112 extending through piston member 108 from a front surface 118 to a rear surface 119 allow suction gas within suction cavity 60 to enter cylinder 56 on the compression side of piston 108.

Figure 2:
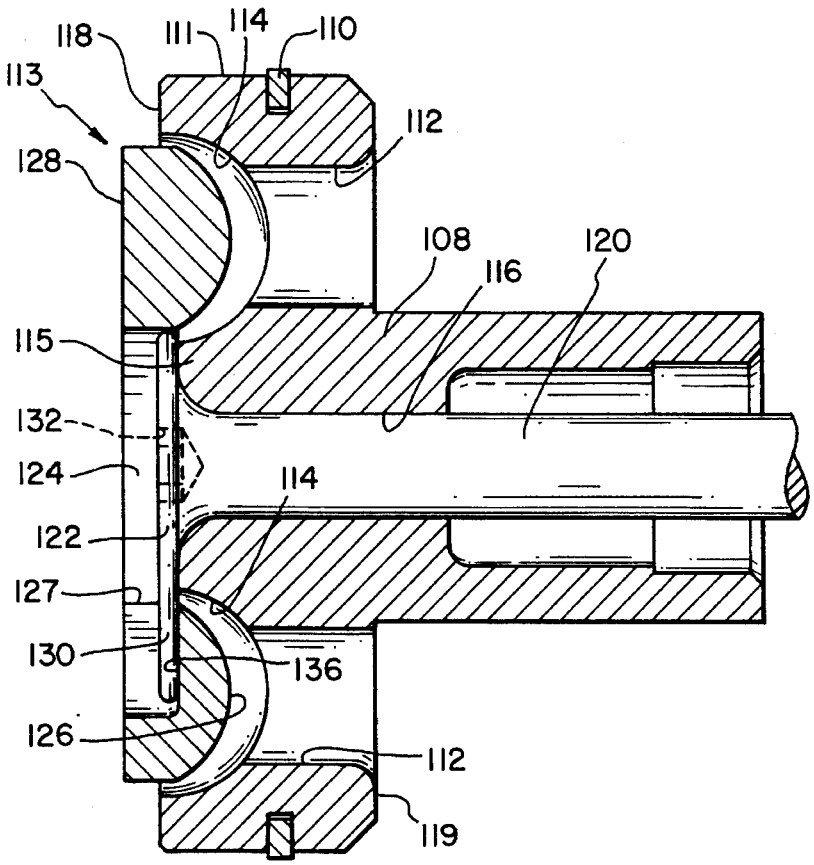
FIG. 2 is an enlarged fragmentary sectional view of the piston assembly of FIG. 1.
Figure 3:
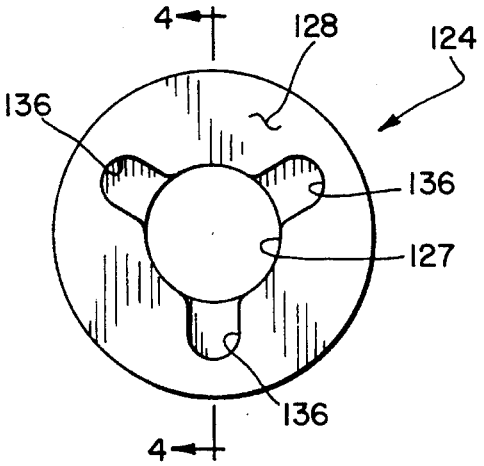
FIG. 3 is a top view of the suction valve of the present invention.

A suction valve assembly 113 is associated with each piston assembly, and will now be described with respect to piston assembly 96 shown in FIG. 2.

Piston member 108 includes a deep semi-torus shaped annular groove 114 in front surface 118 that is in communication with suction ports 112. A raised central conical portion 115, formed by the inner surface of the annular groove 114, includes a central aperture 116 to accommodate elongate threaded clamping bolt 120. Clamping bolt 120 includes a specially shaped head 122 that functions as a valve retainer.

Figure 4:
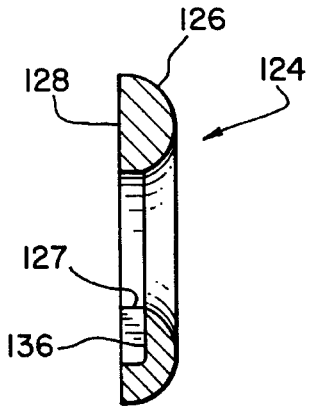
FIG. 4 is a sectional view of the suction valve of FIG. 3 taken along line 4—4 in FIG. 3 and viewed in the direction of the arrows.

The curved sidewalls of annular groove 114 create a seat for a solid semi-torus shaped valve 124. A through opening 127 is centrally located in valve 124. As best shown in FIG. 4, a curved surface 126 of valve 124 faces piston 108 and preferably has the same geometrical dimensions as the annular semi-torus shaped groove or depression 114. The opposite side of valve 124 includes a substantially flat ring surface 128 that is substantially coplanar with piston front surface 118 during the compression stroke of piston member 108. Curved surface 126 of suction valve 124 is substantially immediately exposed to differential pressure during valve opening. It is to be noted that the curved shape of the exposed valve surface has a larger area than any flat surface of prior art valves of the same dimensions that cover suction port 112. This consideration maximizes the exposure of the suction valve effective area to the flow of refrigerant forcing a lift of the valve, and accelerating valve opening which is favorable for compressor performance.

As shown in FIG. 4, the curved surface 126 is an arcuate cross section facing the seating surface of annular groove 114 which is also an arcuate cross section. By forming the passages in the above described way in combination with radiusing of the port and valve entrance and exit edges to minimize the pressure drop across the valve, create conditions for directing flow of the gas more smoothly without sharp turns. This permits gas flow both through opening 127 and around the outside circumference of curved surface 126 during valve opening. Efficiency of the compressor is improved while valve flutter is reduced. Valve flutter is a generating mechanism of intermittent chatter noises within the compressor. Additionally, annular groove 114 acts as a valve guide which is substantially shaped as a frustrum of a cone to prevent binding or jamming of valve 124.

Figure 5:
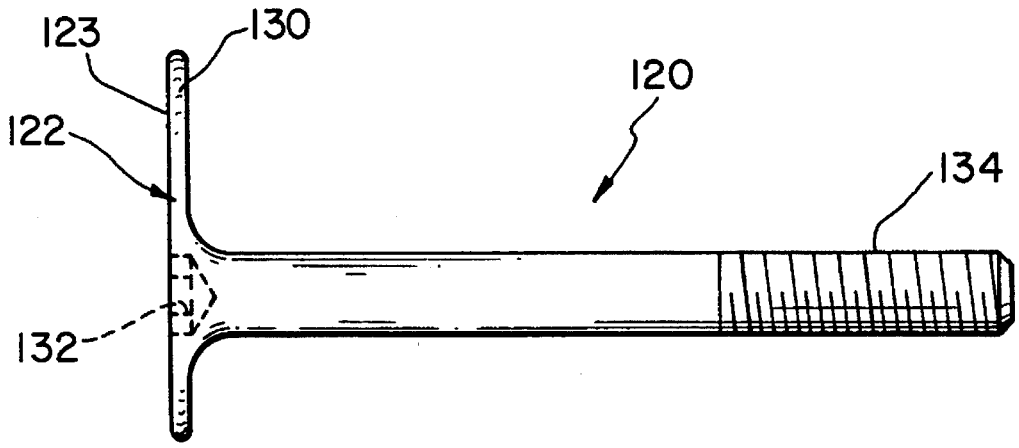
FIG. 5 is an elevational view of the clamping bolt of the present invention.
Figure 6:
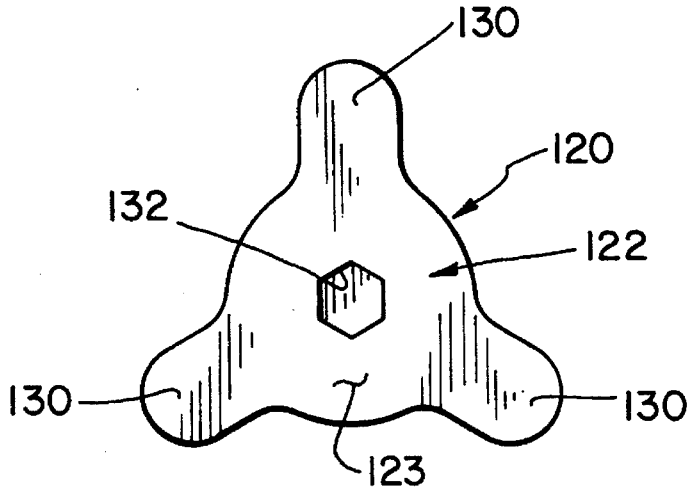
FIG. 6 is a top view of the head of the clamping bolt of FIG. 5.

As suction valve 124 is axially displaced during compressor operation, its axial displacement is defined by a valve retainer formed by the flat shaped head 122 of clamping bolt 120. As shown in FIGS. 5 and 6, the shaped head 122 is flat and an integral part of bolt 120 with a plurality of fingers 130 extending radially therefrom. Shaped head 122 further includes a drive bore 132 to create an attachment location for a hex key so that clamping bolt 120 may be threadedly attached into a yoke member 104 or 106 by threads 134.

Flat ring surface 128 of valve 124 includes a recess 136. During piston assembly, the end portion of every finger 130 is located within its own recess 136 formed in flat ring surface 128. During opening valve 124 at its final open position collides with the free ends of fingers 130. Each finger 130, at this time, behaves as a cantilevered beam spring with clamped free end boundary conditions and load applied to the free end.

As known in the art, infinite variations in shape and size of cantilevered beam type springs are possible. Most variable section beams approximate one of four types, triangular, trapezoidal, parabolic or tapered. In the present invention, impact force is generated during collision of valve 124 with the valve retainer, i.e., shaped head 122, are distributed along the flat ring portion 128 of the valve and applied to the free end of retaining fingers 130 thereby no centrally located or concentrated forces affect both the valve 124 and retainer 122 as in the prior art. The radial extension of fingers 130 improves spring and shock absorption properties of retainer 122 reducing moments of inertia and helps to minimize stresses in the colliding members. The combination of these factors improve the reliability of the valving system.

The clamping bolt head 122, with the top surface 123, is mounted on the top flat portion of the conical portion valve guide 115 in such a way so that the top surface 123 of the bolt head and top surface of the piston 118 are in a single plane. Preferably, the thickness of the clamping bolt head is approximately 0.045 inch with its fingers located 0.065 inch above the bottom of the circular recesses 136 in valve 124. This displacement (0.065 inch) is the valve lift spacing of valve 124.

Suction valve 124 is preferably formed from a high performance polymeric material capable of withstanding a large temperature range, such as −40° F. to 500° F., and impact induced stresses. Preferable polymers include Vespel, available from Dupont Company, Victrex, produced by ICI Company, and Kadel, produced by Amoco Company, having tensile strengths of approximately $32\times10^3$ PSI, high impact strength and low water absorption. These polymers also have a high flexural modulus preferably more than $2.5\times10^6$ PSI with high heat distortion temperatures of over 550° F. at approximately 260 PSI.

It should be noted that the curved shape of the exposed valve surface 126 has a larger effective area which increases and accelerates valve 124 opening, thereby improving efficiency of the compressor. The raised central portion 115 of piston member 108 guides reciprocating movement of valve 124 and is integral with piston 108 having been shaped as a frustrum of a cone with a concave surface. Such a shape of conical portion 115 prevents binding or jamming of valve 126 if any shifting, tilting or other dislocation of valve 126 takes place.

Cylinder head assembly 160 includes cylinder head 134 having a number of web portions 162 that function as valve retainers for discharge valve 142. Head assembly 160 also provides a central hub portion 164 to which attaches discharge valve assembly 138.

In operation, piston assembly 96 will reciprocate within cylinder bore 56. As piston assembly 96 moves from bottom dead center position to top dead center position on its compression stroke, suction valve 124 sliding on guide member 115 and bolt 120 will open and close suction port 112 by virtue of its inertia. As piston assembly 96 moves toward cylinder head assembly 160, gaseous refrigerant within cylinder bore 56 will be compressed and forced through discharge valve assembly 138, past discharge valve 142, and out into discharge pressure space 74 in compressor housing 12.

As piston member 108 reaches top dead center position, radial fingers 130 will substantially completely occupy recess 136, creating a flat front surface area thereby reducing the reexpansion volume. This occurs when piston starts to move toward the bottom dead center. Radial fingers 130 will act as a cantilevered beams and spread inertia forces over the face of valve 124. At this time, the curved surface 126, along with the annular groove 114, will help to accelerate valve openings. Refrigerant will pass by valve 124 both radially outwardly and inwardly along the very smooth gas travel path created. No quick or sharp turns are created that would tend to create a pressure drop of the refrigerant.

Piston member 108 will proceed to bottom dead center position and reverse direction allowing suction valve 116 to continue forward on guide member 115 and bolt 120 and seal suction port 112. The suction stroke is now complete and a compression stroke begins once more.

It is evident that the valve system described herein is applicable to other types of compressors other than scotch yoke compressors. The new valve system may be utilized in single or double reciprocating piston compressors as well. The present invention would reduce reexpansion and improve timing of the suction valve in these compressors.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor comprising:

a housing;

a cylinder block having a bore, said cylinder block disposed within said housing;

a cylinder head assembly defining a discharge port, said cylinder head assembly attached over said bore;

a discharge valve mounted to said cylinder head assembly over said discharge port;

a piston disposed within said bore for reciprocation therein, said piston including a front surface having an annular depression therein, a rear surface, and a suction port extending through said piston from said rear surface to said front surface, said suction port at substantially suction pressure;

a drive mechanism for reciprocating said piston within said bore; and a suction valve slidably attached to said piston over said suction port and said front surface, said suction valve having a top surface and a bottom surface, said bottom surface being toroidally shaped whereby during valve opening, said bottom surface is immediately fully exposed to suction pressure.

2. The compressor of claim 1 in which said piston front surface depression includes a semi-torus shaped annular groove to which said suction valve seals, said annular groove in communication with said suction port.

3. The compressor of claim 2 in which said groove communicates with said suction port through a plurality of openings.

4. The compressor of claim 1 in which said valve is formed of a polymeric material.

5. The compressor of claim 1 in which said piston includes a raised central portion of said front surface, said raised central portion engaging said suction valve whereby said raised central portion prevents binding and jamming of said suction valve.

6. The compressor of claim 1 in which said suction valve is slidably attached to said piston by a clamping bolt, said clamping bolt including a radial finger, said radial finger in contact with said top surface when said suction valve is open.

7. The compressor of claim 6 in which said suction valve includes a recess in said top surface, said finger received within said recess when said suction valve is open.

8. The compressor of claim 6 in which said finger during contact with said suction valve locates the focus of opening forces away from the center of said suction valve.

9. The compressor of claim 6 in which said clamping bolt includes a plurality of said fingers.

10. The compressor of claim 6 in which said clamping bolt includes a plurality of said fingers and said suction valve includes a plurality of recesses, each said finger receivable within a respective recess.

11. The compressor of claim 6 in which said finger is triangular in shape.

12. The compressor of claim 6 in which said finger is trapezoidal in shape.

13. The compressor of claim 6 in which said finger is tapered in shape.

14. A compressor comprising:

a housing;

a cylinder block having a bore, said cylinder block disposed within said housing;

a cylinder head assembly defining a discharge port, said cylinder head assembly attached over said bore;

a discharge valve mounted to said cylinder head assembly over said discharge port;

a piston disposed within said bore for reciprocating motion, said piston having a front surface, a rear surface, and a suction port extending through said piston from said rear surface to said front surface, said suction port at substantially suction pressure;

a drive mechanism for reciprocating said piston within said bore;

a suction valve having a top surface and a bottom surface; and a clamping bolt attached to said piston,said clamping bolt including a radial finger, said suction valve slidable along said clamping bolt to open and closed positions, said suction valve sealing said suction port when in said closed position, said radial finger in contact with said top surface when said suction valve is in said open position so that said radial finger reduces opening stress on said suction valve.

15. The compressor of claim 14 in which said finger during contact with said suction valve locates the focus of opening forces away from the center of said suction valve.

16. The compressor of claim 14 in which said suction valve includes a recess in said top surface, said finger received within said recess when said suction valve is in said open position.

17. The compressor of claim 14 in which said clamping bolt includes a plurality of said fingers.

18. The compressor of claim 14 in which said clamping bolt includes a plurality of said fingers and said suction valve includes a plurality of recesses, each said finger receivable within a respective recess.

19. The compressor of claim 14 in which said bottom surface of said suction valve is toroidally shaped whereby when said suction valve slides from said closed piston to said open position, said bottom surface is immediately fully exposed to suction pressure.

20. The compressor of claim 14 in which said piston front surface includes a semi-torus shaped annular groove to which said suction valve seals, said annular groove in communication with said suction port.

21. The compressor of claim 20 in which said groove communicates with said suction port through a plurality of openings.

22. The compressor of claim 14 in which said suction valve is formed of a polymeric material.

23. The compressor of claim 14 in which said piston includes a raised central portion of said front surface, said raised central portion engaging said suction valve whereby said raised central portion prevents binding and jamming of said suction valve.

24. A compressor comprising:

a housing;

a cylinder block having a bore, said cylinder block disposed within said housing;

a discharge valve mounted to said cylinder head assembly over said discharge port;

a piston disposed within said bore for reciprocating motion, said piston including a front surface having an annular depression therein, a rear surface, and a suction port extending through said piston from said rear surface to said front surface, said suction port at substantially suction pressure;

a drive mechanism for reciprocating said piston within said bore;

a polymeric suction valve slidably attached to said piston over said suction port and said front surface, said suction valve having a top surface and a bottom surface, said bottom surface toroidally shaped; and a clamping bolt attached to said piston, said clamping bolt including a radial finger, said suction valve slidable along said clamping bolt to open and closed positions, said suction valve sealing said suction port when in said closed position, said radial finger in contact with said top surface when said suction valve is in said open position, whereby said radial finger reduces opening stress on said suction valve.

25. The compressor of claim 24 in which during said suction valve sliding from said closed position to said open position, said bottom surface is immediately fully exposed to said suction pressure.

26. The compressor of claim 25 in which said piston front surface depression includes a semi-torus shaped annular groove to which said suction valve seals, said annular groove in communication with said suction port.

27. The compressor of claim 26 in which said groove communicates with said suction port through a plurality of openings.

28. The compressor of claim 25 in which said piston includes a raised central portion of said front surface, said raised central portion engaging said suction valve whereby said raised central portion prevents binding and jamming of said suction valve.

* * * * *